US009267672B2

(12) United States Patent
Pfund et al.

(10) Patent No.: US 9,267,672 B2
(45) Date of Patent: Feb. 23, 2016

(54) DUAL CONTROL LUMINAIRE

(71) Applicant: SYLVAN R. SHEMITZ DESIGNS INCORPORATED, West Haven, CT (US)

(72) Inventors: David R. Pfund, Woodbridge, CT (US); Paul R. Ford, New Haven, CT (US)

(73) Assignee: SYLVAN R. SHEMITZ DESIGNS, LLC, West Haven, CT (US)

( * ) Notice: Subject to any disclaimer, the term of this patent is extended or adjusted under 35 U.S.C. 154(b) by 182 days.

(21) Appl. No.: 14/064,832

(22) Filed: Oct. 28, 2013

(65) Prior Publication Data

US 2014/0049969 A1 Feb. 20, 2014

Related U.S. Application Data

(63) Continuation of application No. 13/006,493, filed on Jan. 14, 2011, now abandoned.

(60) Provisional application No. 61/295,362, filed on Jan. 15, 2010.

(51) Int. Cl.

| | |
|---|---|
| ***F21V 23/00*** | (2015.01) |
| ***F21V 23/06*** | (2006.01) |
| ***H01R 24/00*** | (2011.01) |
| *F21V 23/02* | (2006.01) |

(52) U.S. Cl.

CPC ..... *F21V 23/009* (2013.01); *F21V 23/06* (2013.01); *H01R 24/00* (2013.01); *F21V 23/02* (2013.01)

(58) Field of Classification Search

CPC ..... F21V 23/009; F21V 23/06; F21V 23/02; H01R 24/00

See application file for complete search history.

(56) References Cited

U.S. PATENT DOCUMENTS

| | | | | |
|---|---|---|---|---|
| 2,970,222 | A * | 1/1961 | Husby | F21S 8/08 250/239 |
| 5,803,590 | A * | 9/1998 | Wedell | F21S 8/086 362/263 |
| 5,841,203 | A | 11/1998 | Chambers et al. | |
| 6,100,791 | A | 8/2000 | Bader et al. | |
| 7,330,115 | B1 | 2/2008 | Zuba | |
| 2009/0141511 | A1 | 6/2009 | Gergets et al. | |
| 2011/0175542 | A1 * | 7/2011 | Pfund | H01R 24/00 315/291 |
| 2012/0139426 | A1 * | 6/2012 | Ilyes | F21V 23/02 315/152 |
| 2015/0223301 | A1 * | 8/2015 | Maa | H05B 33/0842 315/112 |

OTHER PUBLICATIONS

Bypass Plug, [online]; retrieved from the Internet http://www.vinotheque.com/custserv/VinoOwnMan.pdf, p. 19, accessed Jan. 14, 2010.

Saabscene, [online]; retrieved from the Internet http://www.saabscene.com/forum/index.php?showtopic=31643681, accessed Jan. 14, 2010.

(Continued)

*Primary Examiner* — Mary Ellen Bowman
(74) *Attorney, Agent, or Firm* — Cantor Colburn LLP

(57) ABSTRACT

Disclosed is a luminaire including a luminaire housing, a lamp or ballast disposed at least partially within the luminaire housing, a first control input disposed at least partially internal to or integral with the luminaire housing, a second control input disposed external to the luminaire housing, and connection components configured to associate the lamp or ballast with the first control input and the second control input.

27 Claims, 3 Drawing Sheets

(56) References Cited

OTHER PUBLICATIONS

Suzuki-Vitara, [on-line]; retrieved from the Internet http://egi.ebay.co.uk/Suzuki-Vitara-2-0-HDI-109-Bosch-Tuning-Box-Chip-Diesel_W0QQitemZ260520897179QQihZ016QQcategoryZ72205QQcmdZViewItem, accessed Jan. 14, 2010.

Twenga, [on line]; retrieved from the Internet http://www.twenga.co.uk/dir-Cars-Motorbikes,Car-ignition-lighting,Chip-tuning, accessed Jan. 14, 2010.

* cited by examiner

DUAL CONTROL LUMINAIRE

CROSS REFERENCE TO RELATED APPLICATIONS

This application is a continuation application of U.S. patent application Ser. No. 13/006,493 filed on Jan. 14, 2011, which claims the benefit of U.S. Provisional Application 61/295,362 filed on Jan. 15, 2010, the contents of each of which are incorporated herein by reference thereto.

FIELD

The disclosure relates generally to a luminaire, and more particularly to a luminaire configured for dual control.

BACKGROUND

While luminaires with integral controllers and luminaires that accept plug-in cables from remote controllers and/or control networks are known in the art, a luminaire that may be controllable via internal/integral control and/or external control would be desirable.

SUMMARY

Disclosed is a luminaire including a luminaire housing, a lamp or ballast disposed at least partially within the luminaire housing, a first control input disposed at least partially internal to or integral with the luminaire housing, a second control input disposed external to the luminaire housing, and connection components configured to associate the lamp or ballast with the first control input and the second control input.

Also disclosed is an illumination system including a luminaire with a luminaire housing, a lamp or ballast disposed at least partially within the luminaire housing, a first control input disposed at least partially internal to or integral with the luminaire housing, a second control input disposed external and remote to the luminaire housing, a plug-in port defined by the luminaire housing and communicable with the first control input and the second control input, and a plug-in device insertable into the port, the plug-in device being configured to associate at least one of the first input device and the second input device to the lamp or ballast.

Still further disclosed is a plug-in device insertable into a plug-in port associated with a luminaire including a lamp or ballast, the plug-in port including at least one input receptive to communication with at least a first control input disposed at least partially internal to or integral with the luminaire, and at least one output communicable with the lamp or ballast.

BRIEF DESCRIPTION OF THE DRAWINGS

The foregoing and other features and advantages of the present invention should be more fully understood from the following detailed description of illustrative embodiments taken in conjuncture with the accompanying Figures in which like elements are numbered alike in the several Figures.

DETAILED DESCRIPTION

Figure 2:
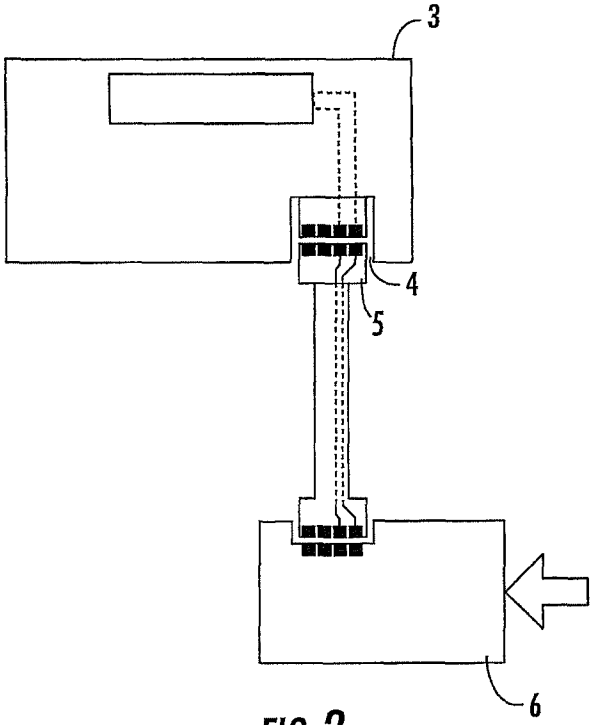
FIG. 2 (PRIOR ART)
FIG. 2 is a schematic view of a known luminaire configured for external control.
Figure 1:
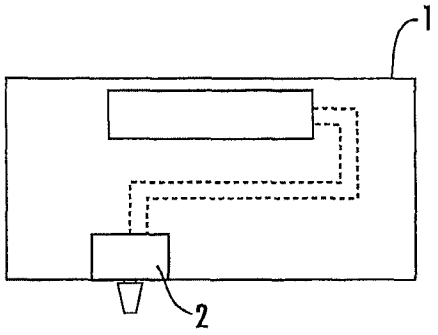
FIG. 1 (PRIOR ART)
FIG. 1 is a schematic view of a known luminaire with an integral controller.

FIGS. 1 and 2 are prior art Figures. FIG. 1 shows a luminaire 1 with an integral controller or input device 2 that allows an operator to switch, dim, or otherwise modulate the luminaire lamp or ballast via a manual actuator, knob or slider integral to the luminaire. Such luminaires typically operate as stand-alone units. FIG. 2 shows a luminaire 3 with a low-voltage receptacle or port 4 configured to accept a plug-in cable 5 from a remote controller, input device, and/or control network 6 capable of switching, diming or otherwise modulating the luminaire independently or in concert with other luminaires. Such control networks may be based on electrical (wired) or radio-frequency (wireless) communications.

Referring now to FIGS. 3-6, there is disclosed is a illumination system 10. This system 10 shown allows a singularly configured luminaire to interface with multiple control strategies and facilitate the conversion of the luminaire from one control strategy to another. However, embodiments of the invention are not limited to those disclosed in these descriptions and the referenced figures. One skilled in the art will conceive others.

Figure 4:
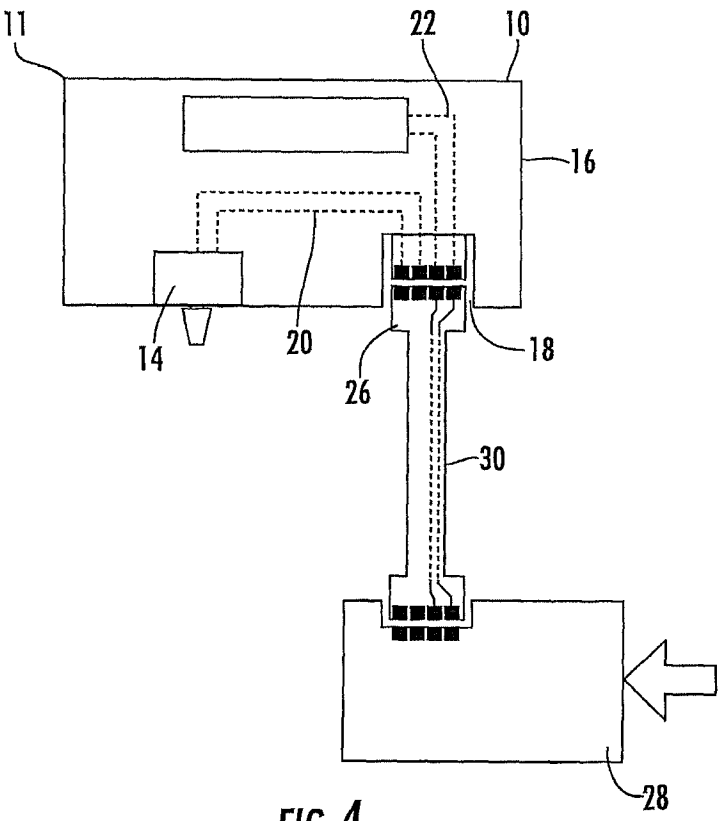
FIG. 4 is a schematic view of the illumination system configured for dual control, as shown in a second configuration.
Figure 3:
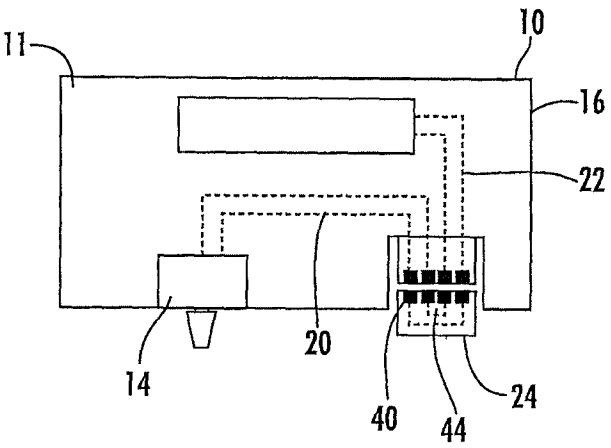
FIG. 3 is a schematic view of an illumination system configured for dual control, as shown in a first configuration.

Referring now to FIGS. 3 and 4, the system 10 includes a luminaire 11, a lamp and/or ballast 12, a luminaire housing 16, first control input 14 integral or at least partially internal to the housing 16, and a plug-in port 18 defined by the housing 16. The control input 14 is connected to the port 18 via output components 20, and the lamp or ballast 12 is connected to the port 18 via input components 22.

Also disclosed is a first removable plug-in device 24 that, when inserted into the port 18, electrically connects the control input 14 to the lamp or ballast 12 via input components 22 (see FIG. 3). In an exemplary embodiment, the control input 14 might be a voltage potentiometer and the ballast might be a fluorescent 0-10V analog dimming ballast whereby the potentiometer is used to vary the ballast output. In the exemplary embodiment of FIG. 3, when the plug-in device 24 is removed, the integral control input 14 is disconnected from the lamp/ballast.

As is shown in FIG. 4, when the plug-in device 22 is removed from the port 18, the port 18 becomes available for insertion of another plug-in device 26. When the plug-in device 26 is inserted in the port 18, the lamp or ballast 12 may be connected to a second control input 28 via input components 22. This second control input 28, which may a network, computing resource, or manual actuator, is disposed externally of and remote to the luminaire 11. The plug in device 26 may associate the control input 28 with the port 18 and input components 22 via a plug-in cable 30 such as that shown in the embodiment of FIG. 4. In another exemplary embodiment (not shown), the plug-in device 26 may communicate with the input control 28 without presence of the cable 28. In such an embodiment, the plug-in device may simply be receptive to wireless signals (RF, etc.) from the input control 28.

It is important to note that, in the exemplary embodiment of FIGS. 3 and 4, the luminaire 11 can be converted back to stand-alone operation by removing the plug-in 26 from the port 18, and re-inserting the plug-in device 24.

Figure 5:
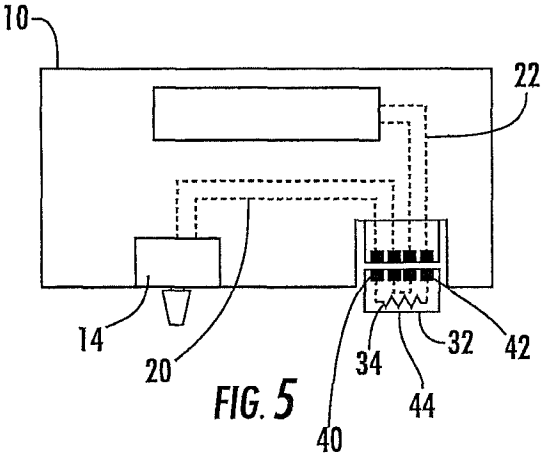
FIG. 5 is a schematic view of the illumination system configured for dual control, as shown in a third configuration.

Referring now to the exemplary embodiment of FIG. 5, another plug-in device 32 is disclosed. This plug-in 32 electrically links the internal control input 14 to dimming ballast as described above, and additionally incorporates a resistor 34. Dimming ballasts (for example analog dimming ballasts) produce a voltage potential across their control connections and vary lamp output according to the operating signal loop impedance/current. This allows the plug-in device 34 to establish a minimum impedance that effects a minimum dimming level by altering communication between the output components 20 and input components 22. Plug-in devices with a variety of impedance ratings are conceived, allowing the minimum dimming level to be selected according to the plug-in device is inserted into the luminaire plug-in receptacle.

Figure 6:
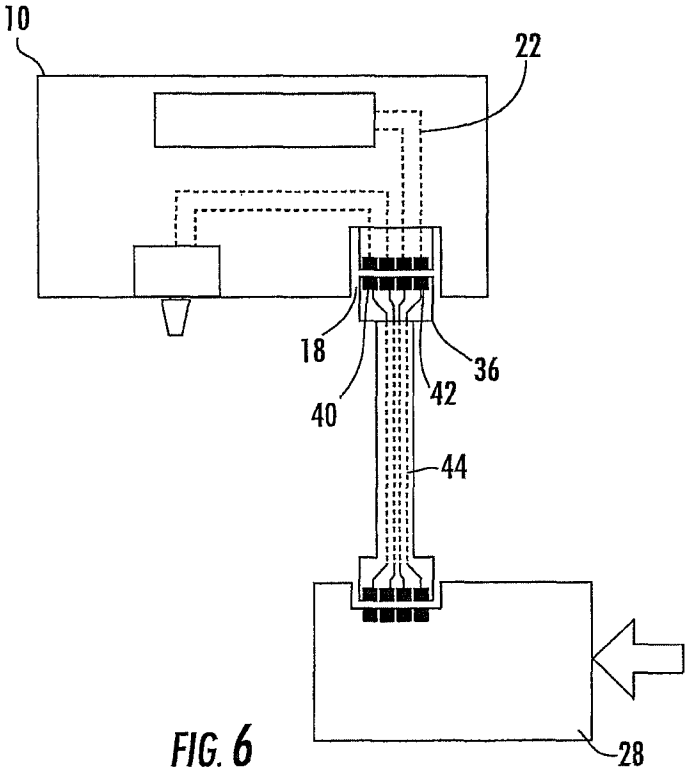
FIG. 6 is a schematic view of the illumination system configured for dual control, as shown in a fourth configuration.

Referring now to the exemplary embodiment of FIG. 6, the external input device 28 communicates input device 14 via a plug-in 36. In this exemplary embodiment, which allows simultaneous connection of the lamp or ballast 12 with input control 14 and input control 28. The external input device 28 arbitrates this input with other wired and RF inputs. It then delivers a corresponding control signal response to the ballast(s) or lamp(s) via the same plug-in 36, port 18 and input components 22. It should be appreciated that this arrangement allows that some or all external wired and/or wireless inputs received at the external input device 28 might override, augment, or otherwise modify the communication between the integral input device 14 and the lamp/ballast 12. Likewise, this arrangement allows that some or all inputs to the integral input device 14 might override, augment, or otherwise modify the communication between the external input device 28 and the lamp/ballast 12.

Again, it is important to note that, in the exemplary embodiment of FIGS. 5 and 6, the luminaire X can be converted back to stand-alone operation by removing the plug-in 26 from the port 18 and re-inserting the plug-in device 32. In addition, the plug-in device 36 (like 26) may communicate with the input control 28 without presence of a cable. In such an embodiment, the plug-in device may simply be receptive to wireless signals (RF, etc.) from the input control 28.

Although not shown in the attached figures, a similar plug-in device is conceived whereby, when inserted into the plug-in port, the plug-in devices may communicate wirelessly with the output components of the integral input device 14, the external input device 28 and the input components 22 of the luminaire rather than communicating via wired connections or cables.

Referring now to FIGS. 3, 5, and 6 in particular, it should be noted that each of the plug-ins 24, 34, and 36 include at least one input 40 receptive to communication with the control input 14. Each of the plug-ins 24, 32, and 36 also include at least one output 42 that is communicable with the lamp or ballast 12 via connections 44.

With more specific reference to the various plug-ins, it should be noted that plug-in 24 and 32 are configured to connect the lamp or ballast 12 to the control input 14 only, while plug-in 26 is configured to connect the lamp or ballast 12 to said second control input 28 only. On the other hand, plug-in 36 is configured to simultaneously connect the lamp or ballast 12 to the control input 14 and the control input 28.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. A luminaire comprising:

a luminaire housing;

a lamp or ballast disposed at least partially within said luminaire housing;

a first control input disposed at least partially internal to or integral with said luminaire housing; and connection components configured to associate said lamp or ballast with said first control input, said connection components comprising:

a plug-in port;

output components extending from said first control input to said plug-in port;

input components extending from said plug-in port to said lamp or ballast; and a plug-in device insertable into said plug-in port and associable with said output components and said input components via said plug-in port.

2. The luminaire of claim 1, wherein said plug-in device is configured to alter communication between said output components and said input components in a desirable manner.

3. The luminaire of claim 1, further comprising a second control input associable with said plug-in device, said second control input being disposed external to said luminaire housing and coupled to said plug-in device via one of a cable or wirelessly.

4. The luminaire of claim 3, wherein said connection components are configured to connect said lamp or ballast to said first control input only or said second control input only.

5. The luminaire of claim 3, wherein said connection components are configured to simultaneously connect said lamp or ballast to said first control input and said second control input.

6. The luminaire of claim 3, wherein said first control input is associable with said lamp or ballast only via a device associated with said second control input.

7. The luminaire of claim 3, wherein said first control input and said second control input are configured to at least one of dim said lamp or ballast and power said lamp and ballast on and off.

8. An illumination system comprising:

a luminaire with a luminaire housing;

a lamp or ballast disposed at least partially within said luminaire housing;

a first control input disposed at least partially internal to or integral with said luminaire housing;

a second control input disposed external and remote to said luminaire housing;

a plug-in port defined by said luminaire housing and communicable with said first control input and said second control input; and a plug-in device insertable into said port, said plug-in device being configured to communicate with at least one of said first control input and said second control input via said port and being configured to associate at least one of said first control input and said second control input with said lamp or ballast via said port.

9. The system of claim 8, wherein said luminaire includes output components extending from said first control input to said plug-in port and input components extending from said plug-in port to said lamp or ballast, said output components being connectable to said input components via said plug-in device.

10. The system of claim 9, wherein said plug-in device is configured to alter communication between said output components and said input components in a desirable manner.

11. The system of claim 9, wherein said input components are configured to connect said lamp or ballast to said plug-in device.

12. The system of claim 8, wherein said plug-in device is configured to connect said lamp or ballast to said first control input only or said second control input only.

13. The system of claim 8, wherein said plug-in device is configured to simultaneously connect said lamp or ballast to said first control input and said second control input.

14. The system of claim 8, wherein said first control input is associable with said lamp or ballast only via a device associable with said second control input and said plug-in device.

15. The system of claim 8, wherein said first control input and said second control input are configured to at least one of dim said lamp or ballast and power said lamp and ballast on and off.

16. A plug-in device insertable into a plug-in port associated with a luminaire including a lamp or ballast, the plug-in port comprising:

at least one input receptive to communication with at least a first control input disposed at least partially internal to or integral with the luminaire; and at least one output configured to communicate with the lamp or ballast, said plug-in device being configured to associate said at least one input and said at least one output.

17. The plug-in device of claim 16, wherein said plug-in device is receptive to communication with said first control input and a second control input disposed external and remote to the luminaire.

18. The plug-in device of claim 17, wherein said input and said output are configured to connect the lamp or ballast to said first control input only or said second control input only.

19. The plug-in device of claim 17, wherein said input and said output are configured to simultaneously connect said lamp or ballast to said first control input and said second control input.

20. The plug-in device of claim 17, wherein said plug-in device associates said first control input with the lamp or ballast via a device associated with said second input.

21. The plug-in device of claim 16, wherein a connection between said at least one input and said output is configured to alter communication between said first control input and said lamp or ballast in a desirable manner.

22. The luminaire of claim 1, wherein said first control input is an operator interface.

23. The luminaire of claim 22, wherein said operator interface is a potentiometer.

24. The luminaire of claim 1, wherein said plug-in device is configured to provide communication between said output components and said input components at said plug-in port.

25. The luminaire of claim 3, wherein said plug-in device is configured to provide communication between said second control input and said input components via said plug-in port.

26. The system of claim 8, wherein said plug-in device is communicable with said first control input via said plug-in port, and communicable with said second control input, and configured to associate said first control input with said second control input via said port, and configured to associate said second control input with said lamp or ballast via said port.

27. The system of claim 8, wherein said plug-in device is communicable with said first control input via said plug-in port, and communicable with said second control input, and configured to associate said first control input with said second control input via said port, and configured to associate said first control input with said lamp or ballast via said port.

* * * * *